US005682713A

United States Patent [19]

Weiss

[11] Patent Number: 5,682,713

[45] Date of Patent: Nov. 4, 1997

[54] ROTATABLE BRACKET SECURING A WINDOW FRAME TO A ROOF

[75] Inventor: David J. Weiss, Stillwater, Minn.

[73] Assignee: Andersen Corporation, Bayport, Minn.

[21] Appl. No.: 658,240

[22] Filed: Jun. 4, 1996

[51] Int. Cl.[6] ..... E04B 7/18

[52] U.S. Cl. ..... 52/200; 52/741.1; 403/231

[58] Field of Search ..... 52/200, 712, 741.1; 403/231, 230, 403, 12, 164, 119, 161, 163; 49/505

[56] References Cited

U.S. PATENT DOCUMENTS

| | | | |
|---|---|---|---|
| 4,033,570 | 7/1977 | Curlow | 403/231 X |
| 4,296,576 | 10/1981 | Rice, Jr. et al. | 52/713 X |
| 5,044,133 | 9/1991 | Sampson et al. | 52/200 X |
| 5,271,124 | 12/1993 | Sandell | 52/200 X |
| 5,355,644 | 10/1994 | Guhl et al. | 52/200 |
| 5,357,720 | 10/1994 | O'Keeffe et al. | 52/200 X |
| 5,509,361 | 4/1996 | Chen | 403/231 X |
| 5,546,712 | 8/1996 | Bixby | 52/200 |

FOREIGN PATENT DOCUMENTS

| | | | |
|---|---|---|---|
| 561860 | 5/1975 | Switzerland | 403/231 |

*Primary Examiner*—Wynn E. Wood
*Assistant Examiner*—Aimee E. McTigue
*Attorney, Agent, or Firm*—Merchant, Gould, Smith, Edell, Welter & Schmidt, P.A.

[57] ABSTRACT

A bracket used to secure a window frame to a roof. The bracket has a rectangular geometry, a means of securing the bracket to the roof and a means of rotating the body along the planar axis of the bottom of a frame. The bracket has a first orientation where the long edges are parallel with the frame, and a second orientation where the short edges are parallel with the frame. The bracket is rotatable with a plurality of orientations between the first orientation and the second orientation.

13 Claims, 5 Drawing Sheets

306
100
100

100

110
102
115
114
L2
C2
L3
C3
L4
C4
L5
C5
L1
C1
106
118
108
112
104
116

ROTATABLE BRACKET SECURING A WINDOW FRAME TO A ROOF

TECHNICAL FIELD

The present invention relates generally to a rotatable bracket utilized to secure a skylight or window to a roof and more particularly to a bracket rotated from a first orientation to a second orientation where the bracket is substantially perpendicular to a skylight's frame and in a suitable position to secure the frame to the roof.

BACKGROUND OF THE INVENTION

The installation of a skylight to the roof of a dwelling requires the securing of a skylight's frame to the dwelling's roof. Skylights can be placed overhead or at eye level and installed to permit a light shaft that is straight, oblique or flared. Roof windows are also installed in a similar manner, but roof windows can be opened and closed.

Presently skylight's frames are attached to the dwelling's roof by brackets that are well known in the art. The brackets range from an angle iron to complicated configurations that are relatively expensive to manufacture.

Angle iron or L-brackets may be utilized to connect the skylight's frame to the roof. Angle iron is commonly available in the construction industry. The angle iron has one side secured to the roof and other edge secured to the external side of the frame. The frame's external side is located above the roof and adjacent to the roofing materials.

A disadvantage of using angle iron is that a side of the angle iron is connected to the external side of the frame. The presence of the angle iron on the external side of the frame is obtrusive to the relatively smooth side of the frame. Also, the angle iron's edge on the external side disrupts the application of the flashing and roofing materials.

Personal safety concerns and minimizing packaging usually require the attachment of the angle iron to the frame on the job site, as compared to joining the two at the factory. The exposed edges of angle iron, attached to the frame prior to shipping, may increase the potential for personal injury. Therefore, the skylight's frame and angle iron are usually shipped from the manufacturer separately. The shipping of separate articles increases the chances of misplacing and losing the bracket(s).

Furthermore, the installation of the angle iron on the job site requires the securing of both edges. The task of securing the edge of the bracket that is on the external side of the skylight's frame can be tedious and time consuming due to the close proximity of the roof surface with the individual's hands and tools.

Manufacturers have designed complicated brackets to overcome the disadvantage of shipping loose bracket(s) and/or having the safety concern of handling angle iron with exposed edges. For example, a commonly used bracket is a folding bracket. Folding brackets require the manual manipulation of the bracket on the job site to expose the edge to be secured to the roof and still requires the securing of the bracket to the frame and roof. The complicated brackets are more costly to manufacture than the angle iron and still have an edge exposed on the external side of the frame.

What has been needed is a bracket that is easy to manufacture and designed to aid in the efficient installation of a skylight or other roof window. Also, in the present invention a frame is shipped with the bracket secured in a relatively safe orientation, whereas in the prior art the bracket was shipped loosely. These and other needs are satisfied by the present invention.

SUMMARY OF THE INVENTION

A bracket used to secure a window frame to a roof. The bracket has a rectangular geometry, a means of securing the bracket to the roof and a means of rotating the body along the planar axis of the bottom of a frame. The bracket has a first orientation wherein the long edges are parallel with the frame, and a second orientation wherein the short edges are parallel with the frame. The bracket is rotatable with a plurality of orientations between the first orientation and the second orientation.

A further aspect of the invention is to provide a bracket that is easy to manufacture and designed to aid in the efficient installation of a window frame.

In accordance with a further aspect of the invention is the bracket, previously connected to frame, is secured to the roof and the roof surface in a position not to impede the installation of the frame.

In accordance with a further aspect of the invention a rounded corner is provided to aid in the rotation between the first orientation and second orientation.

A further aspect of the invention is to provide a groove that is sized and configured to allow the bracket to rotate and to secure the bracket to the roof.

DETAILED DESCRIPTION OF THE INVENTION

Figure 1:
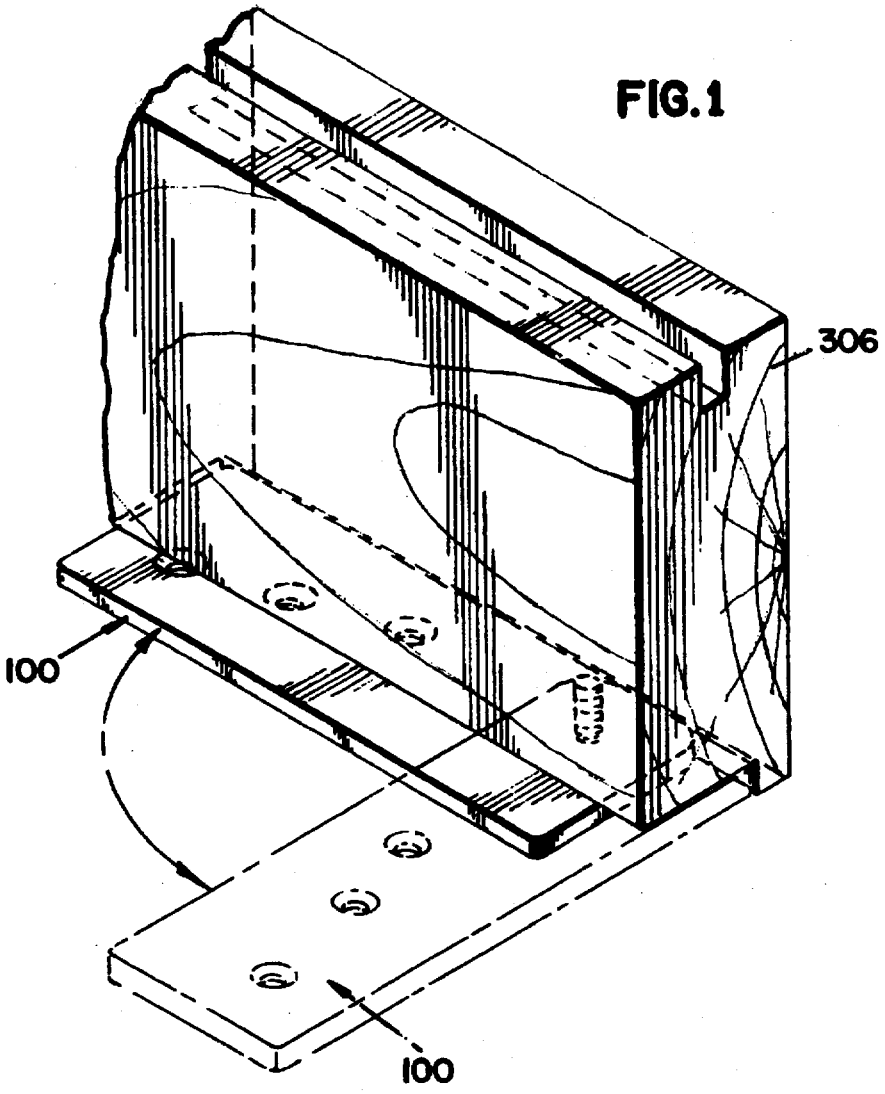
FIG. 1 is a perspective view of a bracket and a portion of a skylight.
Figure 2:
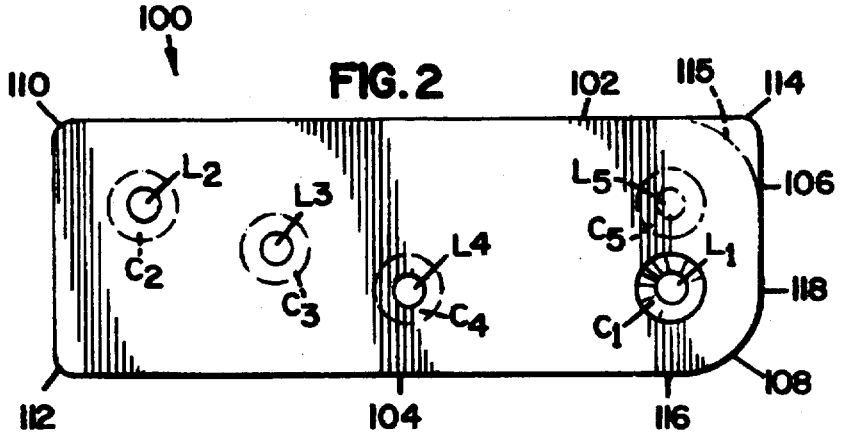
FIG. 2 is a plan view of the rotatable bracket.

Referring to the drawings, wherein like numerals represent like parts throughout the several views, there is generally disposed at 100 a bracket consistent with the principles of the present invention, depicted in FIGS. 1 and 2. The preferred application of this invention is in the installation of a skylight or other roof window (hereinafter skylight) 20 upon the roof 22 of a dwelling, as shown in numerous figures.

Although the example of installing a skylight 20 will be utilized herein, those skilled in the art will appreciate that such application is only one of many circumstances in which the principles of the present application might be utilized. Accordingly, the skylight examples present herein should not be construed in a limiting manner. Also, those skilled in the art will appreciate that although the present invention is illustrated as an installation of a single skylight 20, it should be understood that any number of skylights in tandem can be installed utilizing the present invention, as well as other styles of roof windows.

Figure 3:
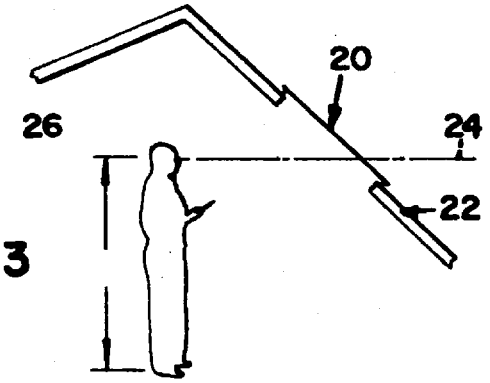
FIG. 3 depicts a skylight in a home.

In order to better present and describe the preferred embodiment of the present invention, a detailed description of the basic installation of a skylight 20 will be discussed. Referring to FIG. 3, there is shown an example of a skylight 20 on the roof 22. An overhead 26 (dotted lines) or eye level 24 placement may be preferable taking into account factors such as the natural light, sunshine, shade, and the optimal view. The types of light shaft(s) available with a skylight are straight, oblique, or flared.

Figure 4:
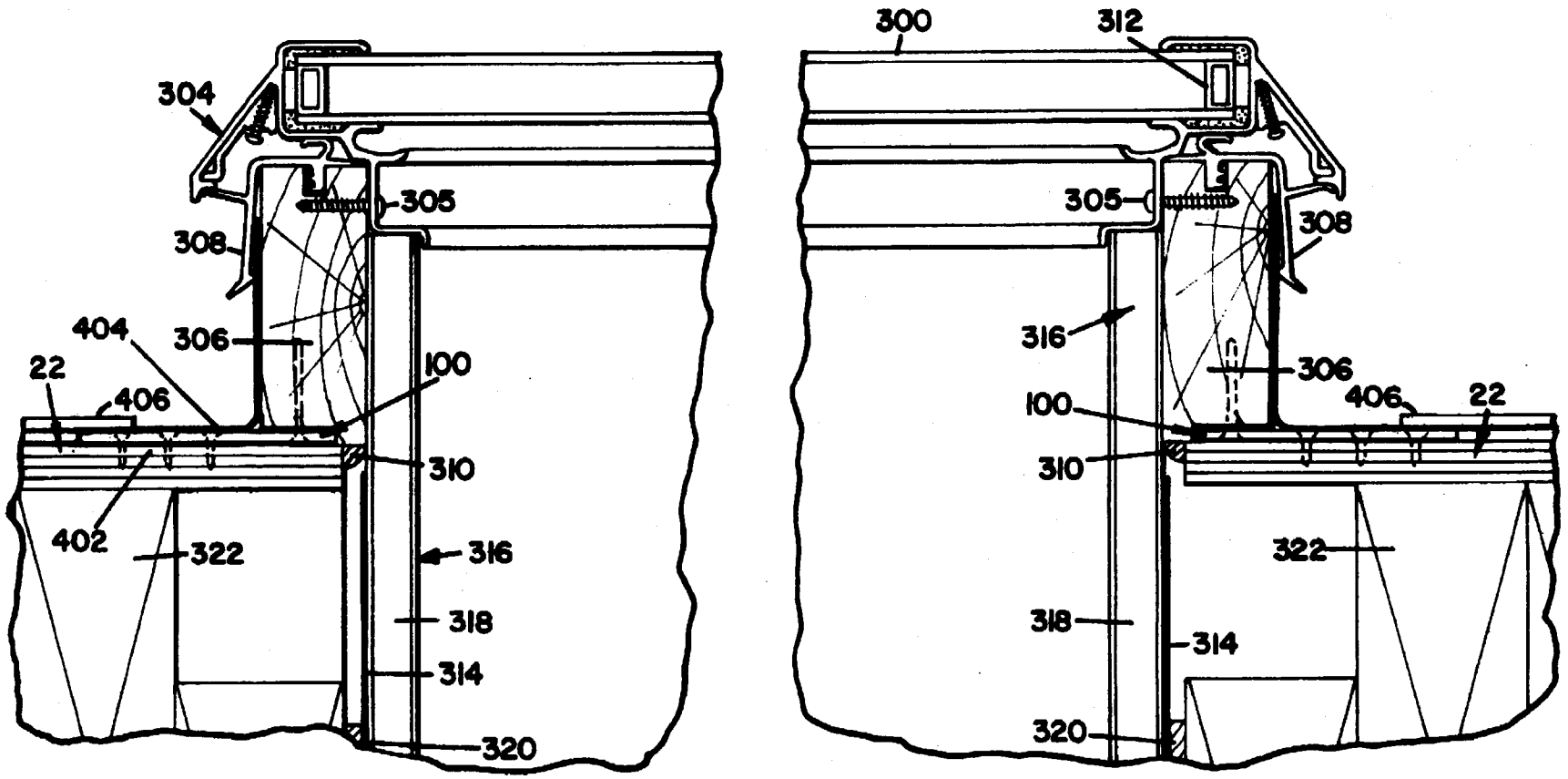
FIG. 4 is a sectional view identifying the mounting technique of the present invention.

Referring to FIG. 4, there is shown the typical mounting technique. The glass pane 300 has an edge disposed in a sash channel or rabbet 312 of a sash 304 which is secured preferably with a plurality of first fasteners 305 to a skylight frame 306. Sash 304 is a framework that encloses the circumference of the glass pane 300. A frame gasket 308 is located between the sash 304 and skylight frame 306. The glass pane 300, sash 304, frame gasket 308, first fastener 305 and skylight frame 306 are well known in the art and may be constructed of various materials in multiple configurations.

A sealant 310 is provided along the joint between the exterior extension 312 of the skylight's frame 306 and the roof deck 22. The sealant 310 is preferably silicone but may be any suitable material. The sealant 310 prevents air and moisture from infiltrating between the skylight's frame 306 and roof deck 22. A vapor barrier 314 is attached just below the drywall channel 316.

The drywall channel 316 is an integral part of the sash 314 configuration. The drywall channel 316 typically has ⅝" thick drywall 318 disposed within the channel or other surfacing material. If required, furring strips 320 are provided on the interior side of the drywall 318 and connected to headers 322 of the roof 22. The furring strips 320 are shims to aid in the appearance and support of the drywall 318.

Figure 5:
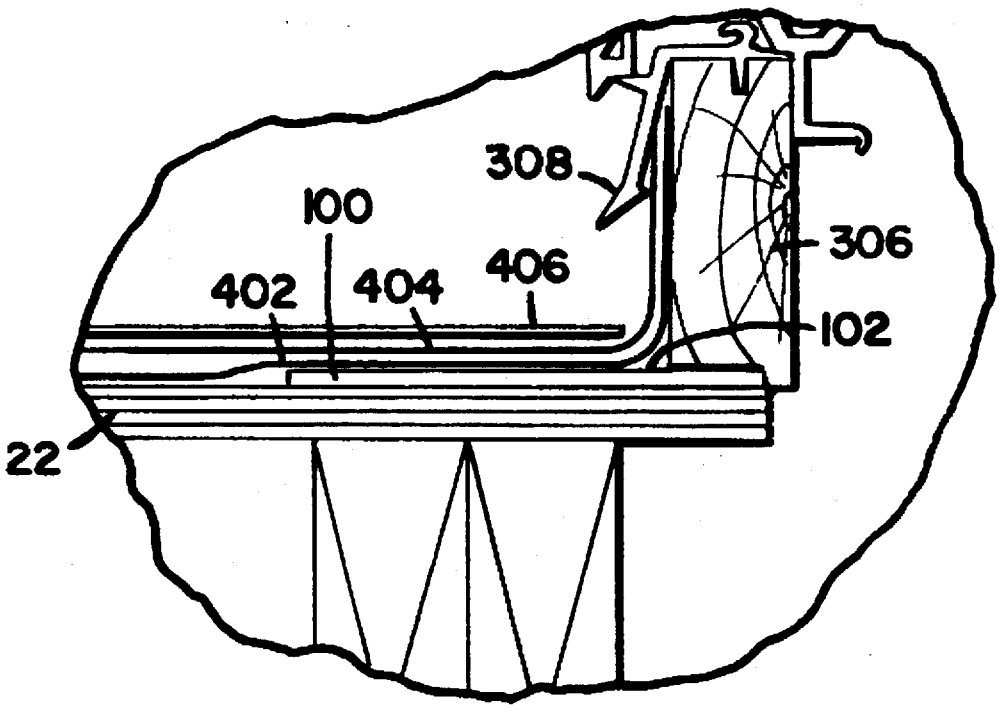
FIG. 5 is a sectional view identifying the roof materials.

Referring to FIG. 5, the skylight frame 306 and associated components are placed over an opening in the roof 22. Roof felt 402 is disposed over the exposed portion of the top surface 102 of bracket 100. Roofing felt 402 is also disposed beneath the frame gasket 308. Flashing 404 is typically placed over the roofing felt 402 and disposed beneath the frame gasket 308. Flashing is used in waterproofing the connection between the skylight and roof, and is preferably sheet metal but other materials are permissible. A shingle 406 is installed above the flashing 404 and exposed to environmental elements, such as the rain, sleet or snow. The roofing materials are well known in the art and are manufactured of various materials depending upon aesthetics, functionality and economics of the particular installation.

Figure 6:
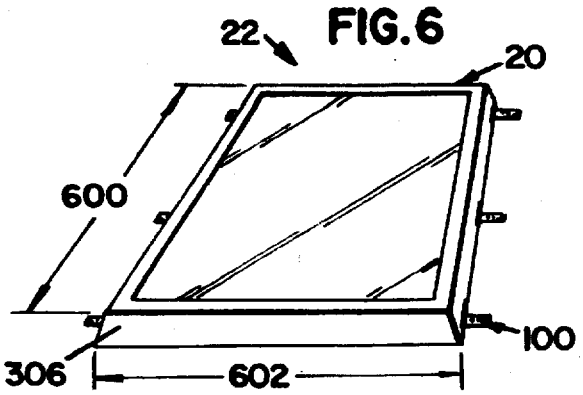
FIG. 6 is a perspective view of a skylight with the present invention's brackets thereon.
Figure 8:
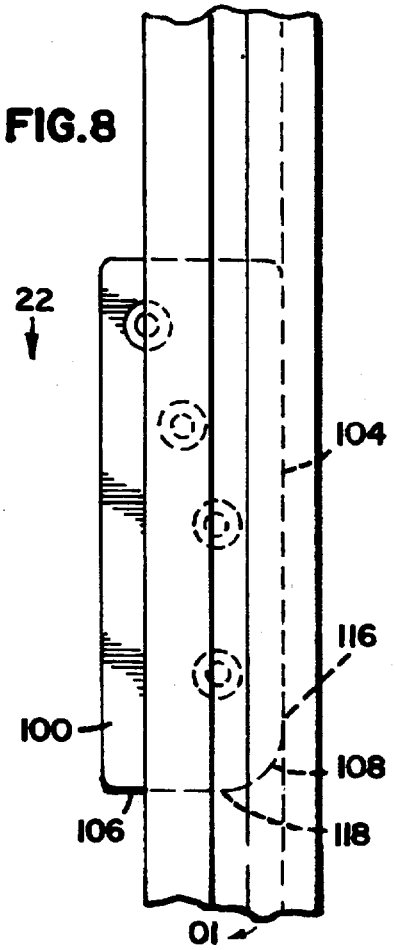
FIG. 8 is a top view depicting a skylight frame and bracket in a first orientation.
Figure 9:
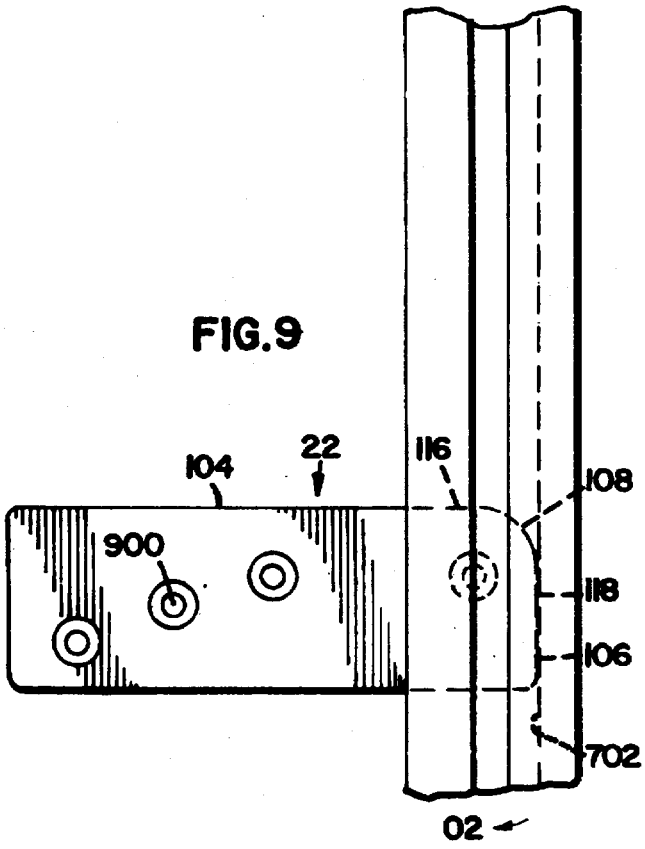
FIG. 9 is a top view depicting a skylight frame and bracket in a second orientation (mounting position).

Referring to FIG. 6, typically the length 600 of a skylight 20 is 27" through 72" with a width 602 being 21 ½" through 44" with various combinations commercially available. A 72" long window will usually have six (6) brackets 100 to secure the skylight's frame 306 to the roof 22, typically attached along length 600. Bracket 100 may also be attached along width 602. The roof pitch or characteristic varies from 2/12 (9 degrees), 4/12 (18 degree), 20.75/12 (60 degree), or 68/12 (80 degree) each pitch may require a different number of brackets 100 and a different flashing method. Turning to FIG. 2, the bracket 100 of the present invention is preferably a rectangular block with dimensions of approximately 1.5"× 4.0"×0.120". The preferable material of construction is metal. The bracket 100 has a thickness t1 which is less than the width w1 which is less than the length 11. The bracket 100 may also be constructed of a non-metal and/or with different dimensions and still be consistent with the principles of the present invention. FIGS. 8 and 9 show a long edge 104, short edge 106, rounded corner 108, top surface 102, bottom surface 120, and smooth corners 110, 112, 114 are also indicated, and most clearly visible in FIG. 2.

Figure 7:
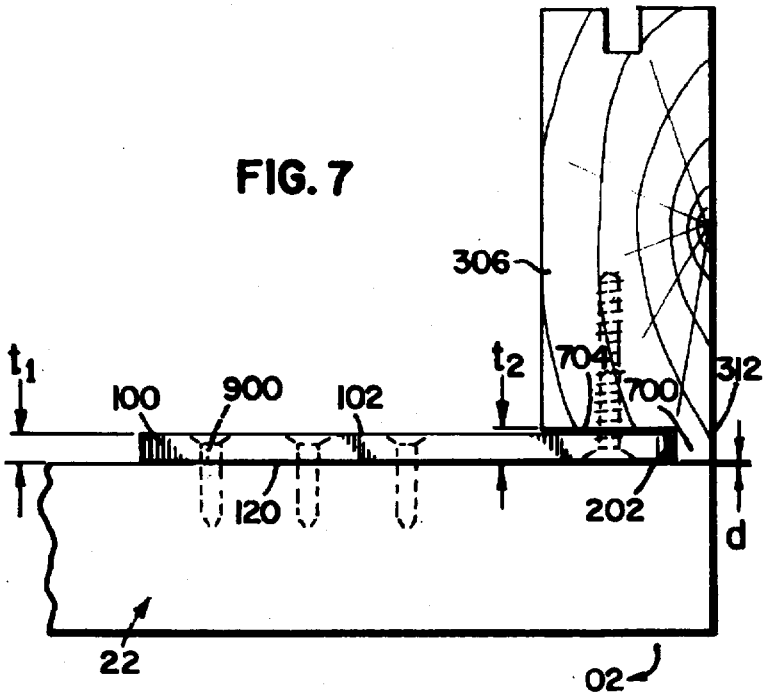
FIG. 7 is an expanded side sectional view depicting the bracket and skylight frame in a second orientation (mounting position).

Referring to FIG. 7, the thickness t1 of the bracket 100 is less than extension thickness t2 of the extension 700 a projection of the skylight's frame 306 after a section is removed to accommodate the bracket 100. The extension 700 has an exterior side 312 and an interior side 702. The extension thickness t2 is typically 0.125" with a width w2 of 0.25" for the entire length 600 of skylight's frame 306, other dimensions are possible and consistent with the scope of the present invention.

Figure 10:
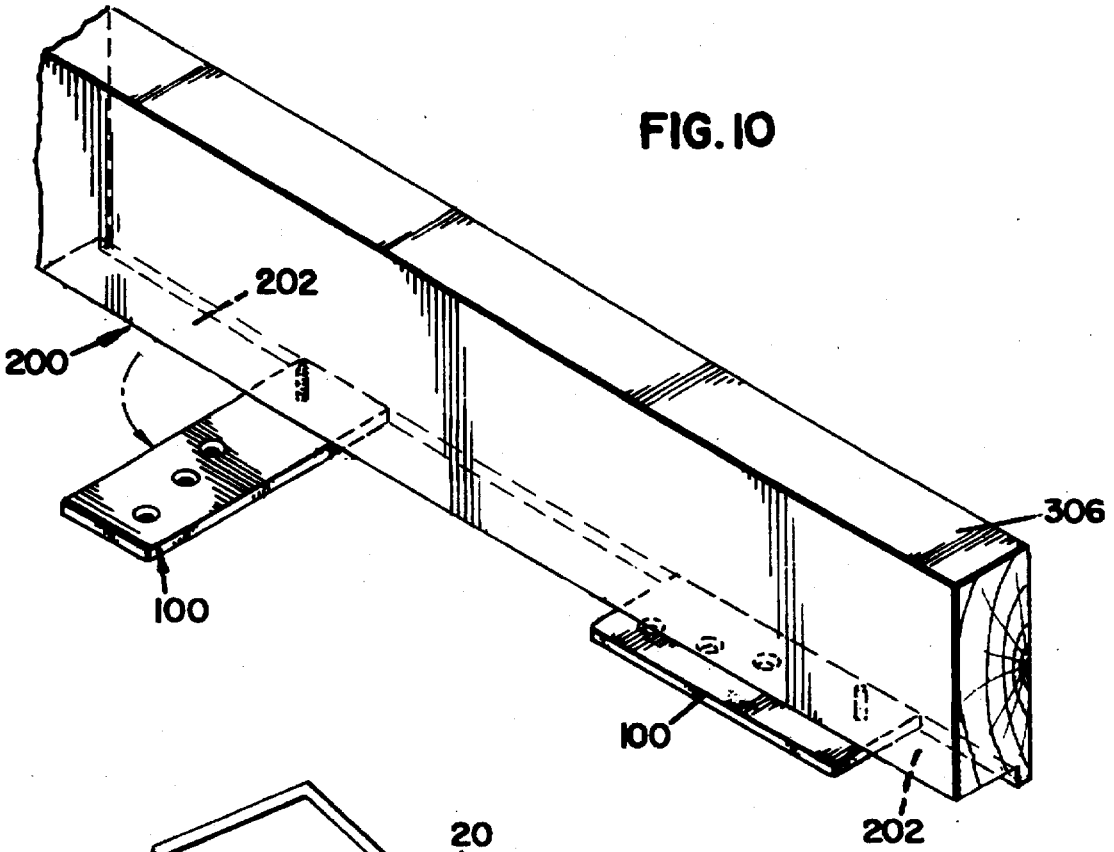
FIG. 10 is a perspective view of the bracket mounted within a groove of the frame.

Referring to FIG. 10, another embodiment of the invention utilizes a channel or groove 200 located within the skylight's frame 306. The grove 200 is sized and configured to encompass a portion of the bracket 100. The groove 200 has a thickness t3 and an interior side 202. The thickness t3 and interior side 202 exist and function in the same manner as they do in the preferred embodiment. A groove 200 is used at every location where a bracket 100 is needed.

Referring again to FIG. 7, the difference d between the bracket's thickness t1 and the section thickness t2 is such that the bracket 100 may be rotated from it's first orientation 01 (FIG. 8) to a second orientation 02 (FIG. 9) while the skylight frame 306 is in a position for mounting on the roof 22. The extension thickness t2 is greater than the bracket thickness t1 by approximately 0.05", although other distances which allow rotation of bracket 100 and securing of the skylight 20 are permissible.

A portion of the top surface 102 is in contact with the bottom 704 of the skylight's frame 306. The bracket 100 is rotatably secured to bottom 704 of the skylight's frame 306. Dependent upon the curvature of the rounded corner 108 a plurality of rotational ranges are available. The rotatable range is approximately 90 degrees, between a first orientation 01 (FIG. 8) and a second orientation 02 (FIG. 9). The rotatable range of motion is dependent upon the radius of the rounded corner 108.

A first orientation 01, depicted in FIG. 8, occurs when the long edge 104 and first end 116 of bracket 100 is proximate to the interior extension 702. The short end 106 is approximately perpendicular to interior extension 702. The first orientation 01 is typically the position of the bracket 100 used to handle a skylight 20 prior to the actual securing of the skylight 20 to a roof 22.

A second orientation 02, depicted in FIG. 9, occurs when the short edge 106 and second edge 118 is proximate to the interior extension 702. The long end 104 is approximately perpendicular to interior extension 702. The second orientation o2 is the position of the bracket 100 where the bracket 100 is secured to a roof 22.

A second orientation 02, depicted in FIG. 9, shows where the bracket 100 is approximately perpendicular to the skylight frame 306. The short edge 106 is in contact with an interior extension 702. A portion of the top surface 102 is in contact with the bottom edge 704 of the skylight frame 306, depicted in FIG. 7. The bottom surface 120 of bracket 100 is proximate to the roof 22 and has a means for securing, shown as 900. Securing means 900 are shown and depict a plurality of apertures which may be required to secure the bracket 100 to the roof 22 are shown. Typically screws are utilized but alternatives such as nails or tacks are available and consistent with the scope of the invention.

The rounded corner 108 is sized and positioned to rotate the bracket 100 to various orientations, as shown in FIG. 2. The rounded corner 108 has a first edge 116 and second edge 118. The first edge 116 has a smooth contact with the end of the long edge 104. The second edge 118 has a smooth contact with the end of the short edge 106. The segment of the bracket 100 which includes a rounded corner 108, long edge 104, and short edge 106 is relatively smooth. Therefore, the rotation of the bracket 100 occurs in a continuous fluid motion.

The rounded corner 108 has a radius of approximately 0.5", although other lengths are also permissible provided the continuous fluid motion of the rotating bracket 100 is accomplished. A point on the rounded corner 108 is in contact or proximate to the interior extension 702 of the skylight's frame 306 in all orientations. A non-fluid motion is also envisioned with some type of snap fit being envisioned.

A pivot point L1 is located at the center point of the radius of the rounded corner 108 and extends through the bracket 100. A third fastener or securing means 900 is inserted through the pivot point h bracket and into the bottom 704 of the skylight's frame 306. Typically the diameter of the hole is 0.25" with a comparatively sized third fastener, although the diameter may be any size such that the smooth rotation and effective securing of bracket 100 is accomplished. An optional hole L5 is shown in phantom. This optional hole L5 provides the flexibility of mounting the bracket such that it swings left or right. If L5 is present, radius 115 must be present also. This is a preferred bracket construction.

The pivot hole L1 may be countersunk as shown as cl to accommodate the head of a third fastener, which is preferably a screw but alternatives are available. The countersunk cl portion of the pivot point L1 is on the bottom surface 102 providing a substantially flat surface when a third fastener is installed. The head of the third fastener is flush with the bottom surface 102 to aid in the smooth rotation of the bracket 100 when the skylight 20 is in position to be mounted to the roof 22.

Also depicted in FIG. 2 are a plurality of holes L2, L3, L4 which are extended through the bracket 100. Holes L2, L3, and L4 and corresponding fasteners (not shown) are a means of securing the bracket 100 to the roof 22. A single hole and fastener may be enough to secure the bracket 100 to the roof 22. The holes L2, L3, L4 have diameters which are typically 0.25" and the fastener can be a screw or any alternative provided that the skylight is sufficiently secured to the roof 22. There are a multiple variations in the size, placement and number of holes that are permissible to secure the skylight 20 and are consistent with the scope of the present invention.

The holes L2, L3, L4 are positioned on the side of the bracket 100 and are accessible when the bracket 100 is in a second orientation 02. The holes L2, L3, 4 may be countersunk c2, c3, c4 respectively on the top surface 102 of the bracket 100. The countersunk c2, c3, c4 provides a substantially flush top surface 102 when the corresponding fastener is utilized to secure the bracket 100 to the roof 22. Flat head fasteners may be provided in lieu of the countersunk holes.

The number and diameter of holes L2, L3, L4 has a direct relationship to the effective securing of the bracket 100 to the roof 22, which in effect secures the skylight 20 to the roof 22. Therefore, a variation from the bracket 100 as depicted is considered within the scope of the present embodiment.

The bracket 100 has three edges 110, 112, 114 which may be rounded. A typical radius of approximately 0.125" is preferable, although other dimensions are permissible. The rounded edge is provided as a safety precaution so that no sharp edges are present to cut the personnel handling the skylight 20. Dotted line 115 shows an optional feature wherein this corner is rounded, such that the bracket can be mounted through hole L5. Thus, it is preferable to have curved edge 115 when L5 is present.

These and other advantages and features, which characterize the invention, are set forth in the claims annexed hereto and form a further part hereof. However, for a better understanding of the invention, and the advantages and objectives obtained by its use, reference should be made to the drawings, and to the accompanying descriptive matter, in which there is described a preferred embodiment of the invention.

What is claimed is:

1. A bracket used to secure a window frame to a roof, said bracket comprising:

a body having a substantially rectangular geometry, having a width, length and thickness, with two long edges and two short edges, and the thickness less than the width and the width less than length, said body having a top surface and a bottom surface;

a means of securing said body to a roof with a bottom surface of said body proximate to the roof;

a means of rotating said body along a planar axis of a bottom surface of a window frame, a portion of the top surface of said body proximate to a bottom of the window frame;

an extension which is substantially perpendicular to the bottom of the window frame and located near an interior of the window frame, the extension is sized to allow the body to rotate and to secure the bottom surface of the body to the roof; and a rounded corner with a portion that is near an interior side of the extension, said rounded corner is between the long edge and the short edge of said body, wherein said body has a first orientation wherein the long edges of said body are substantially parallel with the window frame, and a second orientation wherein the short edges are substantially parallel with the window frame, whereby said body is rotatable with a plurality of orientations between the first orientation and the second orientation.

2. A bracket according to claim 1 wherein said first orientation and said second orientation has a range of 90 degrees.

3. A bracket according to claim 1 wherein said rotating means comprises a pivot hole in said body wherein a fastener rotatably connects said body to the bottom of the window frame.

4. A bracket according to claim 1 wherein said securing means comprises a securing hole in said body wherein a fastener secures said body to the roof.

5. A bracket used to secure a window frame to a roof, said bracket comprising:

a body having a substantially rectangular geometry, having a width, length and thickness, with two long edges and two short edges, and the thickness less than the width and the width less than length, said body having a top surface and a bottom surface;

a means of securing said body to a roof with a bottom surface of said body proximate to the roof; and a means of rotating said body along a planar axis of a bottom surface of a window frame, a portion of the top surface of said body proximate to a bottom of the window frame;

a groove sized and configured to encompass a portion of the body, said groove sized to allow the body to rotate and to secure the bottom surface to the roof; and a rounded corner with a portion that is near an interior side of the groove, said rounded corner is between the long edge and the short edge of said body, wherein said body has a first orientation wherein the long edges of said body are substantially parallel with the window frame, and a second orientation wherein the short edges are substantially parallel with the window frame, whereby said body is rotatable with a plurality of orientations between the first orientation and the second orientation.

6. A bracket according to claim 5 wherein said first orientation and said second orientation has a range of 90 degrees.

7. A bracket according to claim 5 wherein said rotating means comprises a pivot hole in said body wherein a fastener rotatably connects said body to the bottom of the frame.

8. A bracket according to claim 5 wherein said securing means comprises a securing hole in said body wherein a fastener secures said body to the roof.

9. A bracket according to claim 5 further comprising a second rounded corner on the corner nearest said first rounded corner, and two pivot holes, said first pivot hole is positioned to rotatably secure said body to said window frame such that said first rounded corner is proximate said window frame during rotation and said second pivot hole is positioned to rotatably secure said body to said window frame such that said second rounded corner is proximate said window frame during rotation.

10. A window and bracket combination for being secured to a roof, comprising:

a window having a window frame having a bottom surface;

a bracket having a body having a substantially rectangular geometry, having a width, length and thickness, with two long edges and two short edges, the thickness less than the width and the width less than the length, said body having a top surface and a bottom surface;

means for securing the body to a roof with the bottom surface of the body proximate the roof;

means for rotating the body along a planar axis of the bottom surface of the window frame, wherein the body has a first orientation wherein the long edges of said body are substantially parallel with the window frame, and a second orientation where the short edges are substantially parallel with the window frame, whereby the body is rotatable with a plurality of orientations between the first orientation and the second orientation.

11. The combination of claim 10, wherein the window frame further comprises a groove sized and configured to encompass a portion of the body, the groove is sized to allow the body to rotate and to secure the bottom surface to the roof, whereby the groove has a thickness greater than the thickness of the body.

12. The combination of claim 11, wherein the body further comprises an extension which is substantially perpendicular to the bottom of the window frame and is located near an interior of the window frame, the extension is sized to allow the body to rotate to secure the bottom surface of the body to the roof.

13. A method of installing a window to a roof, the window having a frame with a bottom surface and a bracket having a body having a substantially rectangular geometry, having a width, length and thickness, with two long edges and two short edges, the thickness less than the width and the width less than the length, said body having a top surface and a bottom surface, the method comprising:

securing the bracket to the frame in a first orientation, a portion of the top surface of the body proximate the bottom of the frame, the first orientation having the long edges of the body substantially parallel with the frame;

rotating the body to a second orientation prior to installing on the roof, the second orientation having the short edges substantially parallel with the frame; and securing the bracket to a roof with the bottom surface of the body proximate the roof.

* * * * *